United States Patent [19]

Harada et al.

[11] Patent Number: 4,866,348

[45] Date of Patent: Sep. 12, 1989

[54] DRIVE SYSTEM FOR A THIN-FILM EL PANEL

[75] Inventors: Shigeyuki Harada; Toshihiro Ohba; Yoshiharu Kanatani, all of Nara; Hisashi Uede, Wakayama, all of Japan

[73] Assignee: Sharp Kabushiki Kaisha, Osaka, Japan

[21] Appl. No.: 45,189

[22] Filed: Apr. 28, 1987

Related U.S. Application Data

[63] Continuation of Ser. No. 718,239, Apr. 1, 1985, abandoned.

[30] Foreign Application Priority Data

Apr. 2, 1984 [JP] Japan ..... 59-66166
Apr. 11, 1984 [JP] Japan ..... 59-73621

[51] Int. Cl.[4] ..... G09F 9/00

[52] U.S. Cl. ..... 315/169.3; 340/781; 340/825.81

[58] Field of Search ..... 315/169.3, 169.2, 107; 340/781, 825.81

[56] References Cited

U.S. PATENT DOCUMENTS 3,885,196 5/1975 Fischer ..... 340/781
4,032,818 6/1977 Chan ..... 315/169.2
4,338,598 7/1982 Ohba et al. ..... 340/825.81
4,485,379 11/1984 Kinoshita et al. ..... 340/825.81

OTHER PUBLICATIONS

Nikkei Electronics, Apr. 2, 1979, "Practical Applications of Thin-Film Electroluminescent (EL) Character Display".

*Primary Examiner*—Robert L. Griffin
*Assistant Examiner*—T. Salindong
*Attorney, Agent, or Firm*—Birch, Stewart, Kolasch & Birch

[57] ABSTRACT

A drive circuit for a thin-film electroluminescent (EL) matrix display panel includes an odd side N-ch high voltage MOS driver, and an odd side P-ch high voltage MOS driver connected to odd number scanning electrodes of the thin-film electroluminescent (EL) matrix display panel. Even number scanning electrodes of the thin-film electroluminescent (EL) matrix display panel are connected to an even side N-ch high voltage MOS driver and an even side P-ch high voltage MOS driver. The four MOS drivers are effectively controlled to perform an alternating current driving of the thin-film electroluminescent (EL) matrix display panel. A source level switching circuit is connected to the odd side and even side N-ch high voltage MOS drivers so as to switch the source voltage in synchronization with the field driving of the thin-film electroluminescent (EL) matrix display panel.

15 Claims, 4 Drawing Sheets

DRIVE SYSTEM FOR A THIN-FILM EL PANEL

This application is a continuation of application Ser. No. 718,239 filed on Apr. 1, 1985, now abandoned.

BACKGROUND OF THE INVENTION

1. FIELD OF THE INVENTION

The present invention relates to a drive system for a thin-film electroluminescent (EL) matrix display panel.

2. DESCRIPTION OF THE PRIOR ART

The conventional drive circuit for a thin-film electroluminescent (EL) matrix display panel includes high-voltage N-ch MOS drivers performing pull-down function, and diodes performing pull-up function. An example of the conventional drive circuit is disclosed in Nikkei Electronics, April 2, 1979, "Practical Applications of Thin-Film Electroluminescent (EL) Character Display".

In such a conventional drive circuit, the phase relationship between the write pulse and the field refresh pulse sequentially varies depending on the scanning electrodes. And, the pre-charging voltage produces a D.C. voltage depending on whether the data side electrode is selected or is not selected. Furthermore, the amplitudes of the write voltage and the refresh pulse are asymmetrical to each other. This creates deterioration in the voltage-brightness characteristics of the alternating current driving thin-film electroluminescent (EL) matrix display panel. Therefore, the conventional drive circuit can not ensure a stable operation of the thin-film electroluminescent (EL) matrix display panel for a long time.

OBJECTS AND SUMMARY OF THE INVENTION

Objects of the Invention

Accordingly, an object of the present invention is to provide a novel drive system which ensures the stable operation of an alternating current driving capacitive type thin-film electroluminescent (EL) display panel for a long time.

Another object of the present invention is to provide a drive system for a thin-film electroluminescent (EL) matrix display panel, which minimizes deterioration of the voltage-brightness characteristics of the thin-film electroluminescent (EL) matrix display panel.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

SUMMARY OF THE INVENTION

To achieve the above objects, pursuant to an embodiment of the present invention, a scanning side drive circuit for a thin-film electroluminescent (EL) matrix display panel includes a P-ch MOS driver performing a pull-up function in addition to an N-ch MOS driver performing a pull-down function. The N-ch MOS driver and the P-ch MOS driver are combined with each other in a predetermined timing relationship. More specifically, the N-ch MOS driver and the P-ch MOS driver are alternately activated so that the polarity of the voltage applied to the thin-film electroluminescent (EL) matrix display panel is inverted field by field. The phase relationship between the positive and negative pulses applied to the thin-film electroluminescent (EL) display panel is fixed. Also, the amplitudes of the positive and negative pulses applied to the thin-film electroluminescent (EL) display panel are symmetrical.

A basic structure of the above-mentioned drive system is disclosed in a copending U.S. patent application, Ser. No. 664,958, "DRIVE CIRCUIT FOR A THIN-FILM ELECTROLUMINESCENT DISPLAY PANEL", filed on October 26, 1984 by Toshihiro OHBA, Yoshiharu KANATANI and Hisashi UEDE, and assigned to the same assignee as the present application. The British counterpart was filed on October 31, 1984 and assigned application No. 8427528. The German counterpart was filed on October 30, 1984, and assigned application Ser. No. P 34 39 719.1.

In accordance with a preferred form of the drive system of the present invention, a source level switching circuit is connected to the N-ch MOS driver to selectively vary the source voltage of the N-ch MOS transistors at a desired timing synchronous with the driving of the display pan.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
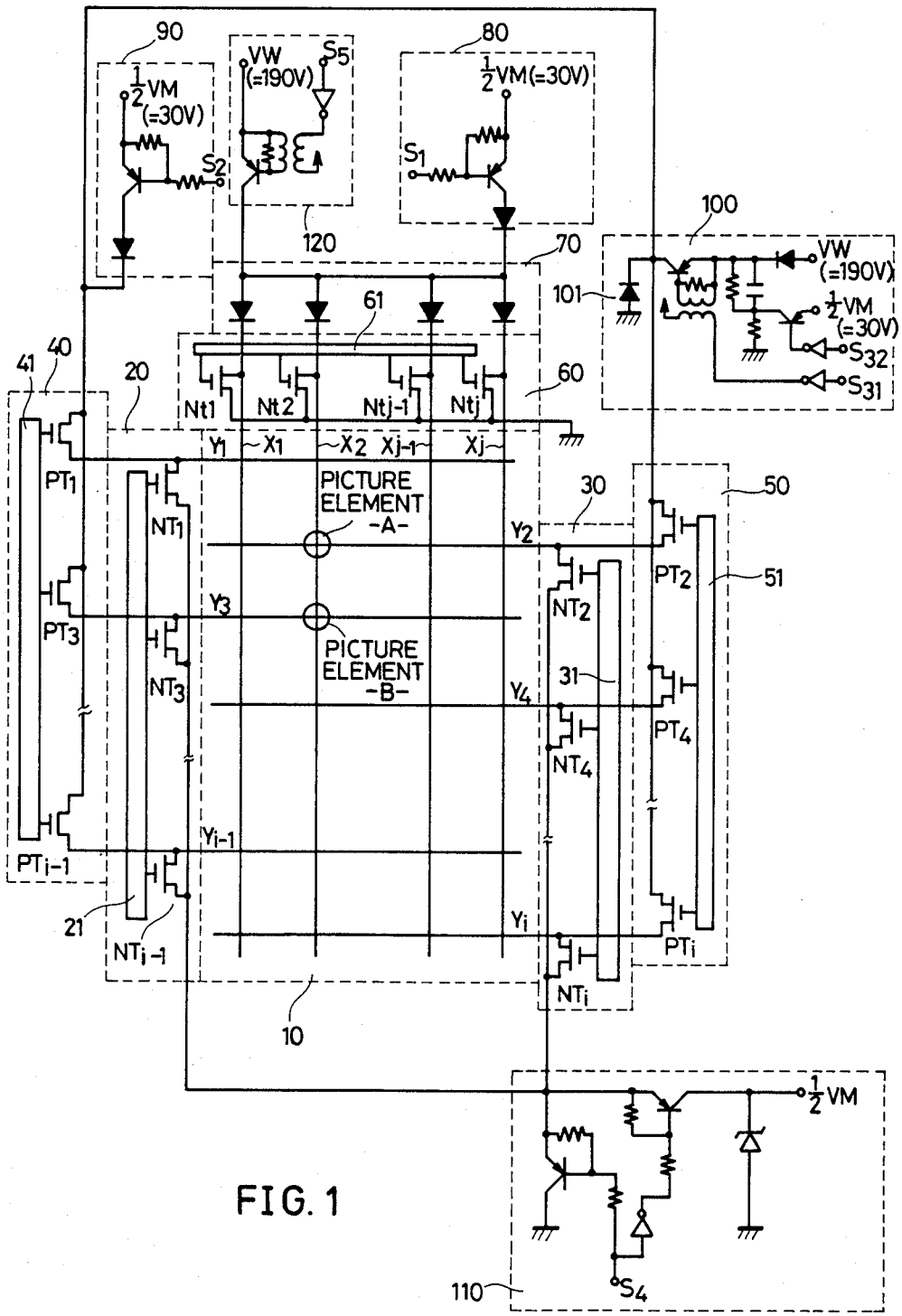
FIG. 1 is a circuit diagram of an embodiment of a drive system for a thin-film electroluminescent (EL) matrix display panel of the present invention.

A thin-film electroluminescent (EL) matrix display panel related to the drive system of the present invention is designated 10 and includes a plurality of data side electrodes and a plurality of scanning side electrodes. N and P (first and second type) high voltage drivers are used to drive the display panel. An odd side N-ch high voltage MOS IC (integrated circuit chip) 20 is connected to the odd-number scanning electrodes, and an even side N-ch high voltage MOS IC 30 is connected to the even-number scanning electrodes. The odd side N-ch high voltage MOS IC 20 includes a logic circuit 21 such as a shift register. The even side N-ch high voltage MOS IC 30 includes a logic circuit 31 such as a shift register. An odd side P-ch high voltage MOS IC 40 is connected to the odd-number scanning electrodes, and an even side P-ch high voltage MOS IC 50 is connected to the even-number scanning electrodes. The P-ch high voltage MOS ICs 40 and 50 include logic circuits 41 and 51, respectively, such as a shift register. A data side N-ch high voltage MOS IC 60 is connected to the data side electrodes. The data side N-ch high voltage MOS IC 60 includes a logic circuit 61 such as a shift register. A data side diode array 70 is provided for separating the data side driving lines, and for protecting the switching elements from the reversed bias. The drive system of FIG. 1 includes a pre-charge driving circuit 80, a pull-up charge driving circuit 90, a write/-refresh driving circuit 100, a source level switching circuit 110, and a data side refresh driving circuit 120. The source level switching circuit 110 functions to switch the source voltage of the N-ch high voltage MOS ICs 20 and 30. The source voltage is normally held at the ground level.

Figure 2:
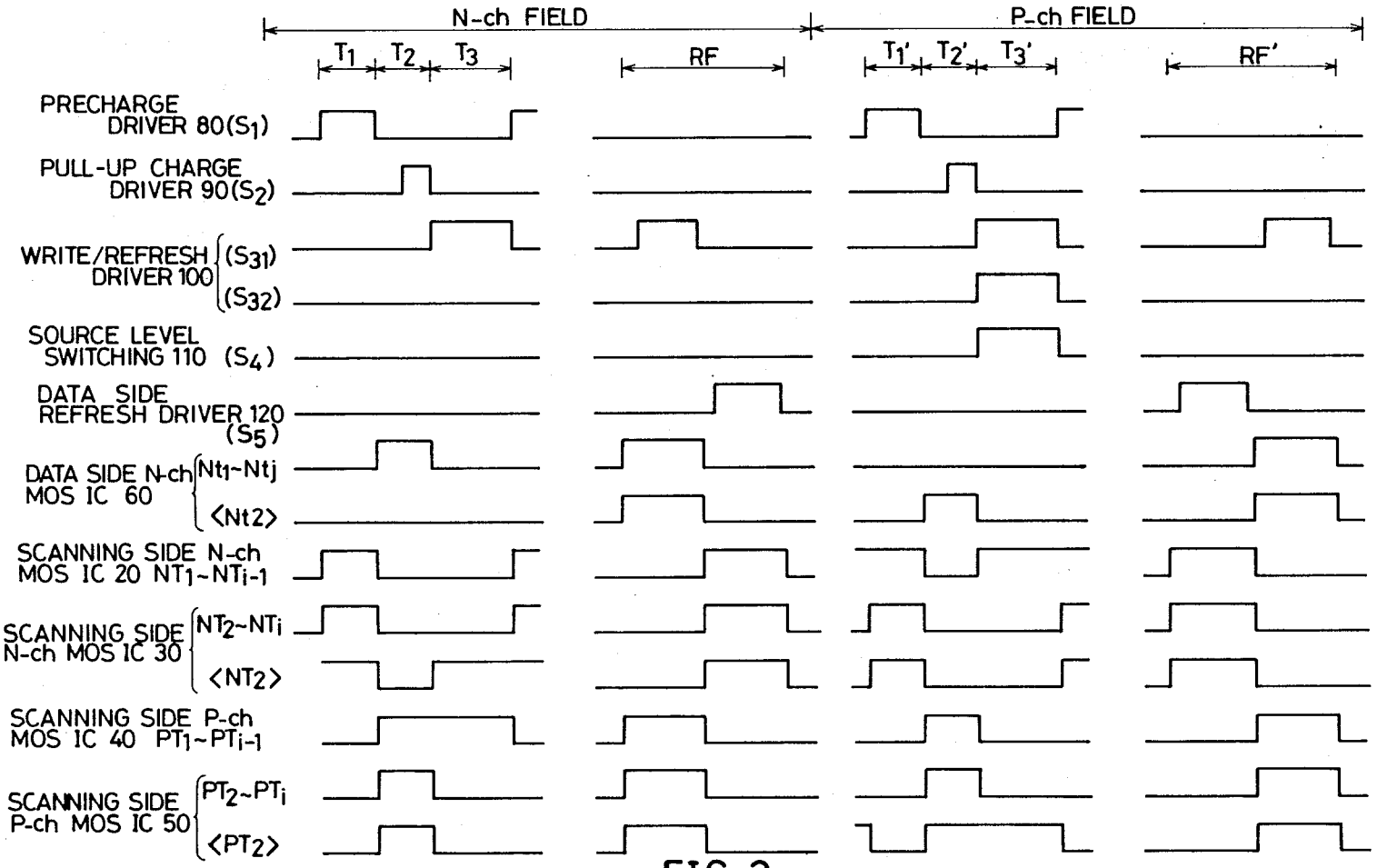
FIG. 2 is a timing chart showing the on-off timing of various circuit elements included in the drive system for a thin-film electroluminescent (EL) matrix display panel of FIG. 1.
Figure 3:
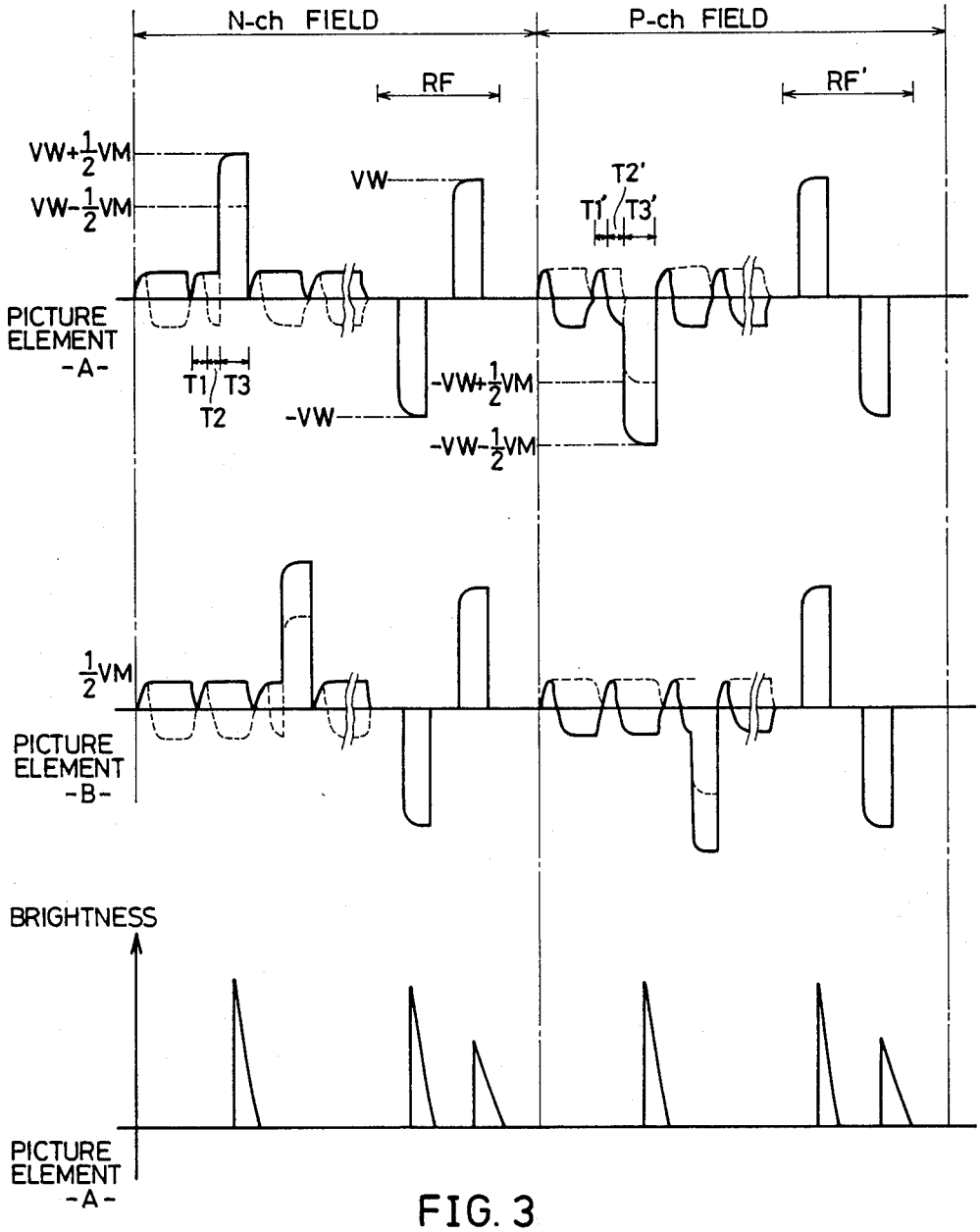
FIG. 3 is a timing chart showing voltage signals applied to picture elements A and B in the thin-film electroluminescent (EL) matrix display panel of FIG. 1, and showing brightness variation at the picture elements A and B in the thin-film electroluminescent (EL) matrix display panel of FIG. 1.

FIG. 2 shows the on-off timing of the circuit elements included in the drive system of FIG. 1, and FIG. 3 shows voltage signals applied to picture elements A and B included in the thin-film electroluminescent (EL) matrix display panel of FIG. 1.

An operational mode of the drive system of FIG. 1 will be described with reference to FIGS. 2 and 3. In the following explanation, a scanning side electrode $Y_2$ including a picture element A is selected as the selected scanning side electrode. In accordance with the present invention, the polarity of the applied voltage signal is inverted field by field. The first field is referred to as the N-ch field, and the second field is referred to as the P-ch field.

N-CH FIELD

In the N-ch field, the source level switching circuit 110 connected to the scanning side N-ch high voltage MOS ICs 20 and 30 maintains the ground level.

N-ch Field First Stage $T_1$: Pre-Charge Period

The entire MOS transistors $NT_1$ through $NT_i$ included in the scanning side N-ch high voltage MOS ICs 20 and 30 are placed in the ON state. At the same time, the pre-charge driving circuit 80 (voltage $\frac{1}{2}V_M=30$ V) is switched on so as to charge the entire panel via the data side diode array 70. During the pre-charge period, the MOS transistors $Nt_1$ through $Nt_j$ included in the data side N-ch high voltage MOS IC 60, and the MOS transistors $PT_1$ through $PT_i$ included in the scanning side P-ch high voltage MOS ICs 40 and 50 are held in the OFF state.

N-ch Field Second Stage $T_2$: Discharge/Pull-Up Charge Period The MOS transistors $NT_1$ through $NT_i$ included in the scanning side N-ch high voltage MOS ICs 20 and 30 are switched OFF. One of the MOS transistors included in the data side N-ch high voltage MOS IC 60 and connected to a selected data side driving electrode (for example, $X_2$) is maintained off, and the remaining MOS transistors included in the data side N-ch high voltage MOS IC 60 are switched ON. Further, the MOS transistors $PT_1$ through $PT_i$ included in the scanning side P-ch high voltage MOS ICs 40 and 50 are switched ON. The charges on the non-selected data side electrodes are discharged through a grounded loop formed, in combination, by the MOS transistors (other than $Nt_2$) included in the data side N-ch high voltage MOS IC 60, MOS transistors $PT_1$ through $PT_i$ included in the scanning side P-ch high voltage MOS ICs 40 and 50, and a diode 101 included in the write/refresh driving circuit 100. Thereafter, the pull-up charge driving circuit 90 (voltage $\frac{1}{2}V_M=30$ V) is switched ON so as to pull each of up the scanning side electrodes to 30 V. At this stage, the MOS transistors $NT_1$ through $NT_i$ included in the scanning side N-ch high voltage MOS ICs 20 and 30 remain off. Consequently, when observed from the scanning side electrodes (Y), the selected data side electrode ($X_2$) is +30 V with respect to the scanning side electrodes, and the non-selected data side electrodes are −30 V with respect to the scanning side electrodes.

N-ch Field Third Stage $T_3$: Write-In Drive Period

Only one MOS transistor $NT_2$ included in the scanning side N-ch high voltage MOS IC 30 and connected to the selected scanning side electrode $Y_2$ is switched ON, and the MOS transistors $PT_2$ through $PT_i$ included in the even side P-ch high voltage MOS IC 50 are switched OFF. The MOS transistors $PT_1$ through $PT_{i-1}$ included in the odd side P-ch high voltage MOS IC 40 are held at the ON state. The write/refresh driving circuit 100 ($V_W=$ 190 V) is switched on so that all of the odd number scanning side electrodes are pulled up to +190 V via the entire MOS transistors $PT_1$ through $PT_{i-1}$ included in the odd side P-ch high voltage MOS IC 40. Due to the capacitive coupling, the selected data side driving electrode is pulled up to +220 V ($=V_W+\frac{1}{2}V_M$), and the non-selected data electrodes are pulled up to +160 V ($=V_W-\frac{1}{2}V_M$).

In the case where one of the odd number scanning side electrodes is selected, the MOS transistors $PT_2$ through $PT_i$ included in the even side P-ch high voltage MOS IC 50 are switched on so as to pull up all of the even number scanning side electrodes to +190 V. The above-mentioned three-staged driving is sequentially conducted for each of the scanning side electrodes $Y_1$ through $Y_i$. Then, a refresh driving is carried out during a blanking period provided before the following P-ch field.

N-ch Field Refresh Period RF

All of the MOS transistors included in the scanning side N-ch high voltage MOS ICs 20 and 30 are held in the OFF state, while all of the MOS transistors included in the data side N-ch high voltage MOS IC 60 and the scanning side P-ch high voltage MOS ICs 40 and 50 are switched ON to pull-down the data side driving electrodes to the ground level. The write/refresh driving circuit 100 is switched ON to pull-up the scanning side driving electrodes to the voltage level $V_W$(=190 V). A refresh pulse (1) having a polarity opposite to the write pulse in the N-ch field is applied to all the picture elements. Thereafter, all the MOS transistors included in the scanning side P-ch high voltage MOS ICs 40 and 50 and the data side N-ch high voltage MOS IC 60 are switched OFF, and the MOS transistors $NT_1$ through $NT_i$ included in the scanning side N-ch high voltage MOS ICs 20 and 30 are switched ON so as to pull down all of the scanning side electrodes to the ground level. The data side refresh driving circuit 120 is switched ON so that all of the data side driving electrodes are pulled up to the voltage level $V_W$(=190 V) via the data side diode array 70. A refresh pulse (2) having the same amplitude but the opposite polarity to the refresh pulse (1) is applied to the entire picture elements.

Due to the polarization effect produced in the thin-film electroluminescent (EL) matrix display panel, the picture elements at which the electroluminescence has occurred during the writing operation produce the electroluminescence in response to the application of the refresh pulses (1) and (2). Although two refresh pulses are applied to the panel in the above embodiment, even one refresh pulse (1) having the polarity opposite to that of the writing pulse can perform a desirable refreshing operation. After completion of the refresh driving, the P-ch field drive is carried out.

P-ch FIELD

P-ch Field First Stage $T_1'$: Pre-Charge Period

The pre-charge operation is conducted in the same manner as the N-ch Field First Stage $T_1$.

P-ch Field Second Stage $T_2'$: Discharge/Pull-Up Charge Period

The MOS transistors $NT_1$ through $NT_i$ included in the scanning side N-ch high voltage MOS ICs 20 and 30 are switched OFF. The MOS transistor (for example, $Nt_2$) included in the data side N-ch high voltage MOS IC 60 and connected to the selected data side driving electrode is maintained at the ON state, and the remaining MOS transistors included in the data side N-ch high voltage MOS IC 60 are switched OFF. At the same time, the MOS transistors $PT_1$ through $PT_i$ included in the scanning side P-ch high voltage MOS ICs 40 and 50 are switched ON. Charges on the selected data side electrode are discharged through a grounded loop formed, in combination, by the on state MOS transistor $Nt_2$ included in the data side N-ch high voltage MOS IC 60, the MOS transistors $PT_1$ through $PT_i$ included in the scanning side P-ch high voltage MOS ICs 40 and 50, and the diode 101 included in the write/refresh driving circuit 100. Thereafter, the pull-up charge driving circuit 90 is switched ON to pull up the entire scanning side electrodes (Y) to 30 V ($=\frac{1}{2}V_M$). At this stage, the MOS transistors $NT_1$ through $NT_i$ included in the scanning side N-ch high voltage MOS ICs 20 and 30 remain OFF. Consequently, when observed from the scanning side electrodes (Y), the selected data side electrode ($X_2$) is −30 V, and the non-selected data side electrodes are +30 V.

P-ch Field Third Stage $T_3'$: Write-In Drive Period

Only the MOS transistor $PT_2$ included in the scanning side P-ch high voltage MOS IC 50 and connected to the selected scanning side electrode $Y_2$ is held in the ON state, and the remaining MOS transistors included in the scanning side P-ch high voltage MOS IC 50 are switched OFF. The MOS transistors $NT_2$ through $NT_i$ included in the even side scanning N-ch high voltage MOS IC 30 are maintained OFF, and the MOS transistors $NT_1$ through $NT_{i-1}$ included in the odd side scanning N-ch high voltage MOS IC 20 are switched ON. The write/refresh driving circuit 100 is switched ON so that the selected scanning side electrode $Y_2$ receives a voltage of 220 V ($=V_W(190\text{ V})+\frac{1}{2}V_M(30\text{ V})$) via the on state MOS transistor $PT_2$. At this stage, the source level switching circuit 110 is switched to 30 V ($=\frac{1}{2}V_M$). The source voltage applied to the odd side scanning N-ch high voltage MOS IC 20 is 30 V, whereby the odd number scanning electrodes are pulled down to +30 V. Due to the capacitive coupling, the selected data side driving electrode $X_2$ is pulled down to −220 V, and the non-selected data side electrodes are pulled down to −160 V.

In the case where one of the odd number scanning electrodes is selected, the MOS transistor included in the scanning side P-ch high voltage MOS IC 40 and connected to the selected scanning electrode, and the MOS transistors $NT_2$ through $NT_i$ included in the scanning side N-ch high voltage MOS IC 30 are switched ON. The above-mentioned three-staged driving is sequentially conducted for each of the scanning side electrodes $Y_1$ through $Y_i$.

P-ch Field Refresh Period RF'

All of the MOS transistors included in the scanning side P-ch high voltage MOS ICs 40 and 50 and the scanning side N-ch high voltage MOS ICs 20 and 30 are switched ON so as to pull down the scanning side driving electrodes to the ground level. The data side refresh driving circuit 120 is switched ON so as to pull up each of the data side driving electrodes to the voltage level of $V_W(=190\text{ V})$ via the data side diode array 70. A refresh pulse (1)' having a polarity opposite to the write pulse in the P-ch field is applied to all of the picture elements. Thereafter, all of the MOS transistors included in the data side N-ch high voltage MOS IC 60 and the scanning side P-ch high voltage MOS ICs 40 and 50 are switched ON so as to pull down the data side driving electrodes to the ground level. The write/refresh driving circuit 100 is switched ON so that the scanning side driving electrodes are pulled up to the voltage level $V_W$ (=190 V). A refresh pulse (2)' having the same amplitude and the opposite polarity to the refresh pulse (1)' is applied to all of the picture elements. As in the case of the N-ch field, the refresh driving of only one refresh pulse (1)' can produce a similar brightness.

The above-mentioned N-ch field drive and the P-ch field drive are alternately conducted. The selected picture element receives the opposing two write-in voltages each having the amplitude of 220 V ($=V_W+\frac{1}{2}V_M$) at the N-ch field and the P-ch field. Further, the selected picture element emits the electroluminescence in response to the application of the refresh voltage of 190 V. That is, the selected picture element performs the electroluminescence at least four times in one cycle of driving including the N-ch field and the P-ch field. In the above-mentioned embodiment, the two refresh pulses are applied in each field. That is, the alternating cycle is completed by the refresh pulse itself. Of course, the entire driving includes symmetrical pulses. That is, the panel driving completes the alternating cycle by the combination of the N-ch field and the P-ch field. The non-selected picture element receives the voltage of 160 V ($=V_W-\frac{1}{2}V_M$) and the refresh pulse of 190 V. However, the non-selected picture element does not produce the electroluminescence because the write-in voltage is less than the threshold level.

Figure 4:
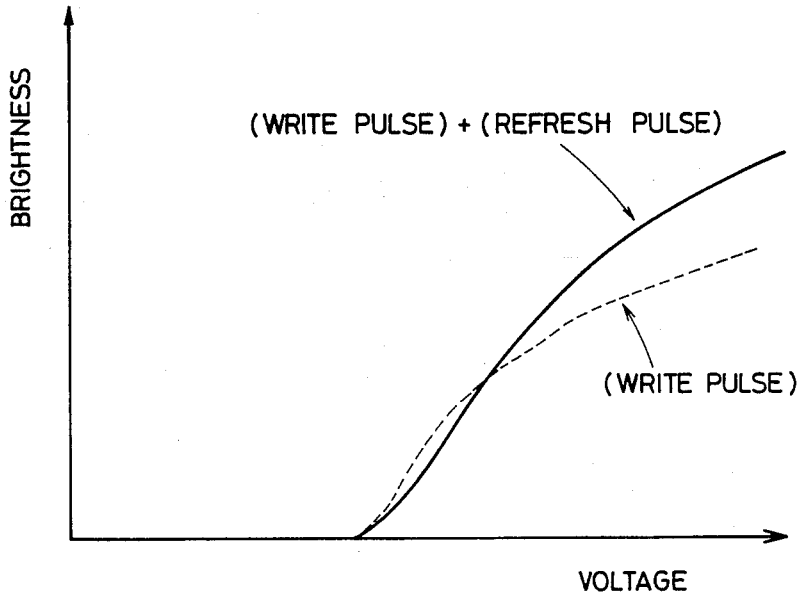
FIG. 4 is a graph showing the brightness versus applied voltage characteristics of the thin-film electroluminescent (EL) matrix display panel of FIG. 1.

Although the refresh pulses are applied to the entire panel in the foregoing embodiment, the refresh driving is not necessarily required to achieve the alternating current driving. The refresh driving is effective only to enhance the brightness. FIG. 4 shows a comparative brightness when the refresh pulse is applied to the entire panel in the drive system of the present invention, and when the refresh pulse is not applied to the entire panel in the drive system of the present invention.

The invention being thus described, it will be obvious that the same may be varied in many ways without departure from the spirit and scope of the invention, which is limited only by the following claims.

What is claimed is:

1. A drive system for a thin-film electroluminescent (EL) matrix display panel comprising:

data side electrodes formed on one major surface of the thin-film electroluminescent (EL) matrix display panel and generally extending in a first direction;

scanning side electrodes formed on the opposing major surface of said thin-film electroluminescent (EL) matrix display panel in a second direction substantially perpendicular to said first direction, said scanning side electrodes being alternately divided into odd number scanning electrodes and even number scanning electrodes;

a pull-up charge driving circuit;

a precharge driving circuit;

a write driving circuit for providing first and second write pulses;

a source level switching circuit;

an odd side first N or P type channel high voltage MOS driver connected to said odd number scanning electrodes at one end thereof, the other end of said odd side first type channel high voltage MOS driver being connected to said source level switching circuit;

an odd side second type channel different from said first type channel high voltage MOS driver connected to said odd number scanning electrodes at one end thereof, the other end of said odd side second type channel high voltage MOS driver being connected to said pull-up charge driving circuit and said write driving circuit;

an even side first type channel high voltage MOS driver connected to said even number scanning electrodes at one end thereof, the other end of said even side first type channel high voltage MOS driver being connected to said source level switching circuit;

an even side second type channel high voltage MOS driver connected to said even number scanning electrodes at one end thereof, the other end of said even side second type channel high voltage MOS driver being connected to said pull-up charge driving circuit and said write driving circuit; and a data side high voltage MOS driver connected to said data side electrodes at one end thereof, the other end of said data side high voltage MOS driver being connected to said precharge driving circuit;

said odd side second type channel MOS driver directing said first write pulse to said odd number scanning electrodes when an even number scanning electrode is selected in a first driving field and directing said second write pulse to a selected odd number scanning electrode when in a second driving field;

said even side second type channel MOS driver directing said first write pulse to said even number scanning electrodes when an odd number scanning electrode is selected in said first driving field and directing said second write pulse to a selected even number scanning electrode in said second driving field;

said first write pulse supplied to each said scanning electrode being provided with a polarity opposite to said second write pulse supplied to that same said scanning electrode with a constant phase relationship therebetween for all said scanning electrodes.

2. The drive system for a thin-film electroluminescent (EL) matrix display panel of claim 1, further comprising a diode array disposed between said data side high voltage MOS driver and said precharge driving circuit.

3. The drive system of claim 1 wherein said first type high voltage MOS drivers are pull down type divers and said second type high voltage MOS drivers are pull up type drivers.

4. A drive system for a thin-film electroluminescent (EL) matrix display panel of claim 2, further comprising:

first means for conducting said first field driving, said first means including;

first activating means for turning on one of a plurality of MOS transistors included in said odd side first type channel high voltage MOS driver; and second activating means for turning on all of a plurality of MOS transistors included in said even side second type channel high voltage MOS driver; second means for conducting the first field driving, said second means including:

third activating means for turning on one of a plurality of MOS transistors included in said even side first type channel high voltage MOS driver; and fourth activating means for turning on all of a plurality of MOS transistors included in said odd side second type channel high voltage MOS driver;

first switching means for switching said source level switching circuit so that the source voltage is maintained at the ground level in said first field driving;

third means for conducting said second field driving, said third means including:

fifth activating means for turning on one of said plurality of MOS transistors included in said odd side second type channel high voltage MOS driver; and sixth activating means for turning on all of the plurality of MOS transistors included in said even side first type channel high voltage MOS driver;

fourth means for conducting the second field driving, said fourth means including:

seventh activating means for turning on one of said plurality of MOS transistors included in said even side second type channel high voltage MOS driver; and eighth activating means for turning on all of the plurality of MOS transistors included in said odd side first type channel high voltage MOS driver; and second switching means for switching said source level switching circuit so that the source voltage is maintained at a pull-up charge level in said second field driving.

5. A drive system for a thin-film electroluminescent (EL) matrix display panel comprising:

data side electrodes formed on one major surface of the thin-film electroluminescent (EL) matrix display panel generally in a first direction;

scanning side electrodes formed on the opposing major surface of said thin-film electroluminescent (EL) matrix display panel in a second direction substantially perpendicular to said first direction, said scanning side electrodes being alternately divided into odd number scanning electrodes and even number scanning electrodes;

a pull-up charge driving circuit;

a precharge driving circuit;

a write/refresh driving circuit for providing a first write pulse, a second write pulse, and a refresh pulse;

a data side refresh driving circuit;

a source level switching circuit;

an odd side first N or P type channel high voltage MOS driver connected to said odd number scanning electrodes at one end thereof, the other end of said odd side first type channel high voltage MOS driver being connected to said source level switching circuit;

an odd side second type channel different from said first type channel high voltage MOS driver connected to said odd number scanning electrodes at one end thereof, the other end of said odd side second type channel high voltage MOS driver being connected to said pull-up charge driving circuit and said write/refresh driving circuit;

an even side first type channel high voltage MOS driver connected to said even number scanning electrodes at one end thereof, the other end of said even side first type channel high voltage MOS driver being connected to said source level switching circuit;

an even side second type channel high voltage MOS driver connected to said even number scanning electrodes at one end thereof, the other end of said even side second type channel high voltage MOS driver being connected to said pull-up charge driving circuit and said write/refresh driving circuit;

a data side high voltage MOS driver connected to said data side electrodes at one end thereof, the other end of said data side high voltage MOS driver being connected to said precharge driving circuit and said data side refresh driving circuit;

said odd side second type channel MOS driver directing said first write pulse to said odd number scanning electrodes when an even number scanning electrode is selected in a first driving field and directing said second write pulse to a selected odd number scanning electrode when in a second driving field;

said even side second type channel MOS driver directing said first write pulse to said even number scanning electrodes when an odd number scanning electrode is selected in said first driving field and directing said second write pulse to a selected even number scanning electrode in said second driving field;

said first write pulse provided to each said scanning electrode being of a polarity opposite to said second write pulse provided to that same said scanning electrode with a constant phase difference therebetween for all said scanning electrodes.

6. The drive system for a thin-film electroluminescent (EL) matrix display panel of claim 4, further comprising a diode array disposed between said data side high voltage MOS driver and said precharge driving circuit and said data side refresh driving circuit.

7. The drive system of claim 4 wherein said first type high voltage MOS drivers are pull down type drivers and said second type high voltage MOS drivers are pull up type drivers.

8. The drive system for a thin-film electroluminescent (EL) matrix display panel of claim 6, further comprising:

first means for conducting said first field driving, said first means including:

first activating means for turning on one of a plurality of MOS transistors included in said odd side first type channel high voltage MOS driver; and second activating means for turning on all of a plurality of MOS transistors included in said even side second type channel high voltage MOS driver;

second means for conducting the first field driving, said second means including:

third activating means for turning on one of a plurality of MOS transistors included in said even side first type channel high voltage MOS driver; and fourth activating means for turning on all of a plurality of MOS transistors included in said odd side second type channel high voltage MOS driver;

first switching means for switching said source level switching circuit so that the source voltage is maintained at the ground level in said first field driving;

first refresh control means for turning on all of a plurality of MOS transistors included in said data side first type channel high voltage MOS driver and all of the plurality of MOS transistors included in said odd side and even side first type channel high voltage MOS drivers;

third means for conducting said second field driving, said third means including:

fifth activating means for turning on one of the plurality of MOS transistors included in said odd side second type channel high voltage MOS driver; and sixth activating means for turning on all of a plurality of MOS transistors included in said even side first type channel high voltage MOS driver;

fourth means for conducting the second field driving, said fourth means including:

seventh activating means for turning on one of the plurality of MOS transistors included in said even side second type channel high voltage MOS driver; and eighth activating means for turning on all of the plurality of MOS transistors included in said odd side first type channel high voltage MOS driver;

second switching means for switching said source level switching circuit so that the source voltage is maintained at a pull-up charge level in said second field driving; and second refresh control means for turning off all of the plurality of MOS transistors included in said data side high voltage driver, and for turning on all of the plurality of MOS transistors included in said odd side and even side first type channel high voltage MOS drivers.

9. A method of driving an electroluminescent matrix display panel having a plurality of pixels defined by data electrodes and scanning electrodes, said scanning electrodes being arranged in alternating even and odd groups comprising the steps of:

(a) precharging all said pixels with a precharge voltage;

(b) selecting data electrodes to be driven and discharging all said pixels associated with data electrodes not selected while applying a pull-up voltage to leave only those pixels associated with the selected data electrode charged;

(c) applying a first writing pulse of a first polarity to said pixels associated with a selected scanning electrode and said selected data electrodes by applying a voltage directly to the other of said even and odd groups to which said selected scanning electrode is associated, said selected scanning electrode being held to a ground level, said applied voltage pulling up said other group of scanning electrodes to form said first writing pulse when superimposed on said precharge voltage to initiate electroluminescence of said pixels associated with said selected scanning and data electrodes;

said steps of (a) precharging, (b) discharging, and (c) applying being performed for each scanning electrode;

(d) applying a refresh pulse of a second polarity opposite to the polarity of said first writing pulse to all said pixels;

(e) subsequently applying a refresh pulse of said first polarity to all said pixels;

(f) precharging all said pixels with a precharge voltage;

(g) selecting data electrodes to be driven and discharging all said pixels associated with the selected data electrode while applying a pull-up voltage to leave only those pixels charged which are associated with data electrodes not selected;

(h) applying a second writing pulse of said second polarity to said pixels associated with a selected scanning electrode and said selected data electrodes by applying a voltage directly to said selected scanning electrode while applying a source level voltage to the other of said even and odd groups to which said selected scanning electrode is not associated, said applied voltage pulling down said data electrodes and developing a net voltage across said pixels associated with said selected scanning and data electrodes to cause electroluminescence;

said steps of (f) precharging, (g) discharging, and (h) applying being performed for each scanning electrode;

(i) applying a refresh pulse of said first polarity to all said pixels;

(j) applying a refresh pulse of said second polarity to all said pixels.

10. A method of driving an electroluminescent matrix display panel having a plurality of pixels arranged in odd and even groups and defined by data electrodes and scanning electrodes, said scanning electrodes being arranged in alternating even and odd groups, selected ones of said pixels forming a display image on said display panel, comprising:

driving each said selected pixel by applying drive signals divided into odd and even fields to the said electrodes defining a said selected pixel by;

(a) driving the said pixels in said odd field by, applying a first precharge voltage to all said scanning electrodes in said odd group, discharging each nonselected pixel not selected for display thereon and pulling said net voltage across said pixel to a pull up voltage of opposite polarity to said first precharge voltage, and supplying a first write voltage to all said pixels, selected said pixels receiving a voltage sum of said first precharge voltage and first write voltage so as to cause luminescence thereof, nonselected said pixels receiving a voltage sum of said first write voltage and said first pull up voltage which is insufficient to cause luminescence, and (b) driving said pixels in said even field by, applying a second precharge voltage to all said scanning electrodes in said odd group, discharging each nonselected pixel not selected for display thereon and pulling said net voltage across said pixel to a second pull up voltage of opposite polarity to said second precharge voltage, and supplying a second write voltage to all said pixels, selected said pixels receiving a voltage sum of said second precharge voltage and second write voltage so as to cause luminescence thereof, nonselected said pixels receiving a voltage sum of said second write voltage and said second pull up voltage which is insufficient to cause luminescence, said first and second precharge, pull up and write voltages each having opposite respective polarities;

said steps (a) and (b) of driving applying to all said scanning electrodes a said write pulse in said odd field and a said write pulse in said even field with a constant phase relationship therebetween.

11. The method of claim 10 wherein said step (a) of driving in said odd field applies a first refresh signal to each said pixel;

said step (b) of driving in said even field applies a second refresh signal having a polarity opposite said first refresh signal to each said pixel.

12. The method of claim 11 wherein each of said first and second refresh signals includes first and second refresh pulses having opposite polarities.

13. A system for driving an electroluminescent matrix display panel having a plurality of pixels arranged in odd and even groups and defined by data electrodes and scanning electrodes, said scanning electrodes being arranged in alternating even and odd groups, selected ones of said pixels forming a display image on said display panel; said system applying drive signals to each said selected pixel, said drive signals being divided into odd and even fields and being supplied to the said electrodes defining a said selected pixel, said system comprising:

first means for driving the said pixels in said odd field by, applying a first precharge voltage to all said scanning electrodes in said odd group, discharging each nonselected pixel not selected for display thereon and pulling said net voltage across said pixel to a first pull up voltage of opposite polarity to said first precharge voltage, and supplying a first write voltage to all said pixels, selected said pixels receiving a voltage sum of said first precharge voltage and first write voltage so as to cause luminescence thereof, nonselected said pixels receiving a voltage sum of said first write voltage and said first pull up voltage which is insufficient to cause luminescence; and second means for driving said pixels in said even field by, applying a second precharge voltage to all said scanning electrodes in said odd group, discharging each nonselected pixel not selected for display thereon and pulling said net voltage across said pixel to a second pull up voltage of opposite polarity to said second precharge voltage, and supplying a second write voltage to all said pixels, selected said pixels receiving a voltage sum of said second precharge voltage and second write voltage so as to cause luminescence thereof, nonselected said pixels receiving a voltage sum of said second write voltage and said second pull up voltage which is insufficient to cause luminescence, said first and second precharge, pull up and write voltage supplied by said first and second drive means each having opposite respective polarities;

said first and second means for driving applying to all said scanning electrodes a said write pulse in said odd field and a said write pulse in said even field with a constant phase relationship therebetween.

14. The system of claim 13 wherein said first means for driving in said odd field applies a first refresh signal to each said pixel;

said second means for driving in said even field applies a second refresh signal having a polarity opposite said first refresh signal to each said pixel.

15. The system of claim 14 wherein each of said first and second refresh signals includes first and second refresh pulses haivng opposite polarities.

* * * * *